US012287181B1

(12) United States Patent
Guardi et al.

(10) Patent No.: US 12,287,181 B1
(45) Date of Patent: Apr. 29, 2025

(54) CONTROL SURFACE DEPLOYMENT AND ACTUATION

(71) Applicant: Marotta Controls, Inc., Montville, NJ (US)

(72) Inventors: Vito Michael Guardi, Staten Island, NY (US); Travis James Spaulding, Verona, NJ (US); John Edward Albright, Hackettstown, NJ (US); Brett Philip Seidman, Morganville, NJ (US)

(73) Assignee: Marotta Controls, Inc., Montville, NJ (US)

( * ) Notice: Subject to any disclaimer, the term of this patent is extended or adjusted under 35 U.S.C. 154(b) by 0 days.

(21) Appl. No.: 18/621,380

(22) Filed: Mar. 29, 2024

(51) Int. Cl.
*F42B 10/14* (2006.01)
*F42B 10/64* (2006.01)

(52) U.S. Cl.
CPC ..... *F42B 10/14* (2013.01); *F42B 10/64* (2013.01)

(58) Field of Classification Search
CPC ..... F42B 10/14; F42B 10/64
See application file for complete search history.

(56) References Cited

U.S. PATENT DOCUMENTS

| | | | | |
|---|---|---|---|---|
| 4,575,025 | A * | 3/1986 | Sadvary | F42B 10/14 244/3.27 |
| 6,588,700 | B2 | 7/2003 | Moore et al. | |
| 6,726,147 | B1 | 4/2004 | Perini et al. | |
| 7,475,846 | B2 | 1/2009 | Schroeder | |
| 7,642,492 | B2 | 1/2010 | Parine et al. | |
| 8,410,412 | B2 * | 4/2013 | Geswender | F42B 10/62 244/3.21 |
| 9,989,338 | B2 | 6/2018 | Osdon | |
| 10,112,698 | B2 * | 10/2018 | Barnes | B64U 30/12 |
| 10,458,764 | B2 | 10/2019 | Willenbring et al. | |
| 11,041,702 | B1 | 6/2021 | Vasudevan et al. | |
| 11,408,715 | B2 * | 8/2022 | Pinoteau | F42B 10/14 |
| 11,644,287 | B2 * | 5/2023 | Travis | F42B 10/14 244/3.28 |

* cited by examiner

*Primary Examiner* — Richard Green
(74) *Attorney, Agent, or Firm* — Lerner David LLP

(57) ABSTRACT

A device for deployment and actuation of a control surface for a maneuverable object, including an actuation shaft arranged for rotation about a longitudinal axis of the device; an output gear arranged concentric with the actuation shaft and configured to unlock the control surface when rotated about the longitudinal axis; and a pin integral with, or attached to, the actuation shaft and protruding through an opening in the output gear, wherein the output gear is operable to rotate about the longitudinal axis independent of the actuation shaft when the pin is in a circumferentially extending portion of the opening, and the output gear and actuation shaft are operable to rotate together about the longitudinal axis when the pin is in a longitudinally extending portion of the opening.

18 Claims, 7 Drawing Sheets

CONTROL SURFACE DEPLOYMENT AND ACTUATION

BACKGROUND

Control surfaces are often used to control the movement of objects through air or water. For example, fins on a missile may be used as control surfaces for guiding the missile to a target. Moreover, such fins may be stowed within the missile prior to launch, deployed after launch, and actuated to control flight of the missile after deployment. Stowing the fins before launch places the missile in a compact configuration so that the missile is more easily stored and transported prior to launch and more easily launched.

BRIEF SUMMARY

It has been recognized that to employ a stowed control surface, the object to be maneuvered by such surface often includes a deployment mechanism to deploy the control surface from a stowed position to a deployed position and an actuation mechanism to drive the control surface when the surface is in the deployed position. It has been further recognized that including a deployment mechanism and an actuation mechanism in the object to be maneuvered adds weight and complexity to the object, while occupying space within the object that could be put to other uses, such as carrying a payload.

In view of the desire to minimize the size and complexity of control surface deployment and actuation mechanisms, the presently disclosed technology is provided. Moreover, the presently disclosed technology provides additional features, such as a mechanism for maintaining a control surface in a deployed position under flight loads without requiring application of an actuation holding force to the control surface; and a mechanism for maintaining the control surface in a fixed position during deployment, or prior to transitioning to controlled flight, without requiring application of an actuation holding force to the control surface.

In one aspect, the presently disclosed technology provides a device for deployment and actuation of a control surface for a maneuverable object, including an actuation shaft configured for pivotal mounting to a control surface shaft, arranged for rotation about a longitudinal axis of the device, and operable to move the control surface shaft when rotated about the longitudinal axis; an output gear arranged concentric with the actuation shaft, arranged for rotation about the longitudinal axis, and configured to unlock the control surface from a stowed position when rotated about the longitudinal axis; and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

In another aspect, the presently disclosed technology provides a control surface system for a maneuverable object, including a control surface; a control surface shaft integral with, or attached to, the control surface; and a device for deployment and actuation of the control surface, the device having an actuation shaft configured for pivotal mounting to the control surface shaft, arranged for rotation about a longitudinal axis of the device, and operable to move the control surface shaft when rotated about the longitudinal axis, an output gear arranged concentric with the actuation shaft, arranged for rotation about the longitudinal axis, and configured to unlock the control surface from a stowed position when rotated about the longitudinal axis, and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

According to still another aspect, control surface systems of the presently disclosed technology may be resettable. For instance, a control surface system of the technology may be reset during a testing and development phase. The ability to reset the system is highly advantageous as a resettable system reduces the burdens associated with testing the system, e.g., in a laboratory, with attendant reductions in time and cost of system development.

BRIEF DESCRIPTION OF THE DRAWINGS

The accompanying drawings are not intended to be drawn to scale. Also, for purposes of clarity not every component may be labeled in every drawing. In the drawings.

DETAILED DESCRIPTION

Examples of systems and methods are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. In the following description, reference is made to the accompanying figures, which form a part thereof. In the figures, similar symbols typically identify similar components, unless context dictates otherwise. Other embodiments may be utilized, and other changes may be made, without departing from the spirit or scope of the subject matter presented herein.

The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Figure 1:
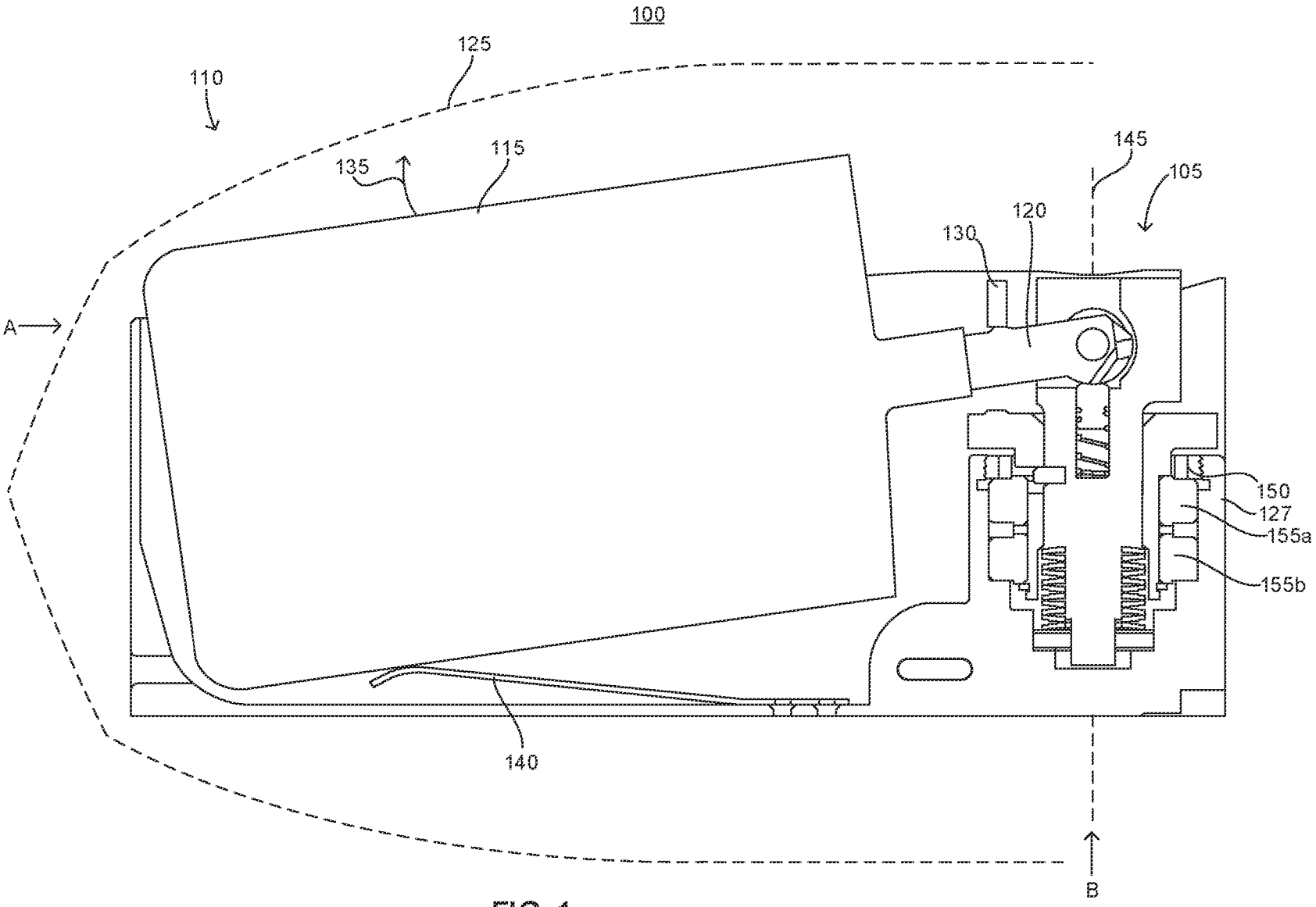
FIG. 1 is a cross-sectional view of a portion of a maneuverable object having a deployment and actuation device in accordance with the presently disclosed technology.

FIG. 1 is a cross-sectional view of a portion 100 of a maneuverable object having a deployment and actuation device 105 in accordance with the presently disclosed technology. The maneuverable object may be, for example, a missile or projectile, and the portion 100 may be located, for example, in a nose section 110 of the missile or projectile. However, it should be noted that while FIG. 1 shows portion 100 located in the nose section 110, location in the nose section 110 is shown for illustrative purposes only. The portion 100, or a similar portion of different shape, may be located in another section of the maneuverable object, such as an aft section of the maneuverable object. Further, a maneuverable object may have more than one deployment and actuation device like the deployment and actuation device 105, with the deployment and actuation devices located at one or more locations in the maneuverable object.

As can be seen from FIG. 1, the portion 100 also includes a control surface 115 and a control surface shaft 120 coupling the control surface 115 to the deployment and actuation device 105. The control surface 115, control surface shaft 120, and deployment and actuation device 105 make up a control surface system according to embodiments. As further illustrated in FIG. 1, the control surface 115 may be stored sub-flush to a body surface of the object, the body surface being generally indicated by phantom line 125, although sub-flush storage is not a requirement of the control surface system.

In operation, the deployment and actuation device 105 may lock the control surface 115 in a stowed position, as shown in FIG. 1. The locking of the control surface 115 in the stowed position may be realized by a restraint portion 130 of the deployment and actuation device 105 bearing on the control surface shaft 120. To deploy the control surface 115, the restraint portion 130 is moved away from the control surface shaft 120 so that the control surface 115 is free to move in a deployment direction, generally indicated by arrow 135. In this manner, if, for example, the object is flying from right-to-left in FIG. 1 such that the body surface 125 is moving right-to-left, the force of wind will be along a direction A (left-to-right) and may act to deploy the control surface 115 when the control surface 115 is unlocked. Nevertheless, the control surface system may include one or more deployment springs that are compressed against the control surface 115 when the control surface 115 is in the stowed position. By way of illustration a single deployment spring, deployment spring 140, is depicted in FIG. 1. The deployment spring 140 applies an inboard-to-outboard directed force to the control surface 115 which acts to deploy the control surface 115 when the control surface 115 is unlocked. Thus, the deployment spring 140 may act to deploy the unlocked control surface 115 without the aid of wind force, with the aid of wind force, or even against wind force. The feature of being able to deploy against the wind is particularly advantageous in situations where deployment is performed in difficult-to-predict aero-loading environments.

As can be further seen from FIG. 1, the deployment and actuation device 105 has a longitudinal axis 145 and may be secured in portion 100 with the longitudinal axis 145 oriented along a direction B, generally inboard-to-outboard. To provide for securing of the deployment and activation device 105 within portion 100, the device 105 may include a spanner nut 150 and one or more roller bearings, e.g., roller bearings 155*a* and 155*b*. The spanner nut 150 may be threaded on an external surface so that the external surface can mate with a threaded portion of a body 127 of the object. The roller bearings 155*a* and 155*b* may be placed such that the longitudinal axis 145 of the device 105 passes through the centers of the roller bearings while allowing parts of the device 105 to rotate about the longitudinal axis 145.

Figure 2:
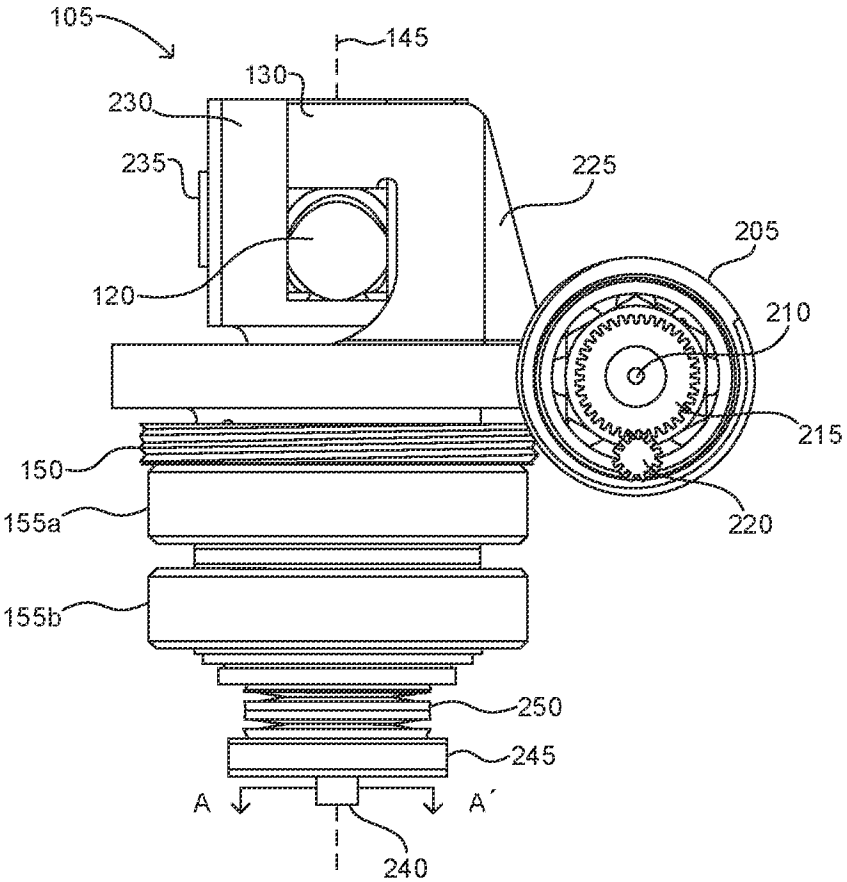
FIG. 2 shows the deployment and actuation device of FIG. 1 as viewed from direction A of FIG. 1.

FIG. 2 shows the deployment and actuation device 105 of FIG. 1 as viewed from direction A of FIG. 1. Also shown in FIG. 2 are a driveshaft bearing 205, a driveshaft 210, a driveshaft gear 215, and a spur gear 220. The spur gear 220 is connected to a motor (illustrated in FIGS. 6 and 7) for rotating the deployment and actuation device 205. The spur gear 220, when rotated by the motor, rotates the driveshaft gear 215 which, in turn, rotates the driveshaft 210. The driveshaft 210 is connected to a worm gear (illustrated in FIGS. 6 and 7) which engages the device 105 and is operable to rotate the device 105 in response the motor. The worm gear may be integral with the driveshaft 210 or coupled to the driveshaft 210 either directly or indirectly. In any event, the driveshaft 210 is radially secured by the driveshaft bearing 205 and rotatable within the driveshaft bearing 205.

It should be noted that the use of a worm gear to rotate the deployment and actuation device 105 is not required. The wide range of mechanisms that may be used to couple the deployment and actuation device 105 to the driveshaft 210 will be readily apparent to one skilled in the art in view of this disclosure.

In FIG. 2, as in FIG. 1, the deployment and actuation device 105 is depicted as locking the control surface 115 in the stowed position. Accordingly, the restraint portion 130 of the deployment and actuation device 105 is shown contacting the control surface shaft 120. As can also be seen in FIG. 2, the restraint portion 130 is part of an output gear 225, the output gear 225 being part of the device 105 and being configured for rotation about the longitudinal axis 145. Further, the output gear 225 is concentric with an actuation shaft 230, the actuation shaft 230 being configured for rotation about the longitudinal axis 145 and being configured for pivotal connection with the control surface shaft 120 (e.g., via a pin 235).

As can be additionally seen from FIG. 2, the deployment and actuation device 105 may include an anti-rotation tab 240, a thrust bearing 245, and a spring 250, and. The anti-rotation tab 240 is part of, or attached to, the actuation shaft 230 and is seated in an anti-rotation tab recess 350 (illustrated in FIGS. 3A, 4A, and 5A) of the body 127 prior to deployment of the control surface 115 so as to prevent rotation of the actuation shaft 230 prior to deployment and actuation of the control surface 115. The thrust bearing 245 is trapped within the body 127. The spring 250 is compressed between the actuation shaft 230 and the thrust bearing 245 and acts to move the anti-rotation tab out of the anti-rotation tab recess 350 to thereby place the deployment and actuation device 105 in a driving position (e.g., a position in which the actuation shaft 230 is free to actuate the control surface 115 for controlled flight). By way of example, the anti-rotation tab 240 may have a cross-section that is rectangular when taken perpendicular to the longitudinal axis 145 (as shown by AA' in FIG. 2), with the anti-rotation tab recess 350 having a similarly shaped cross-section.

Figure 3B:
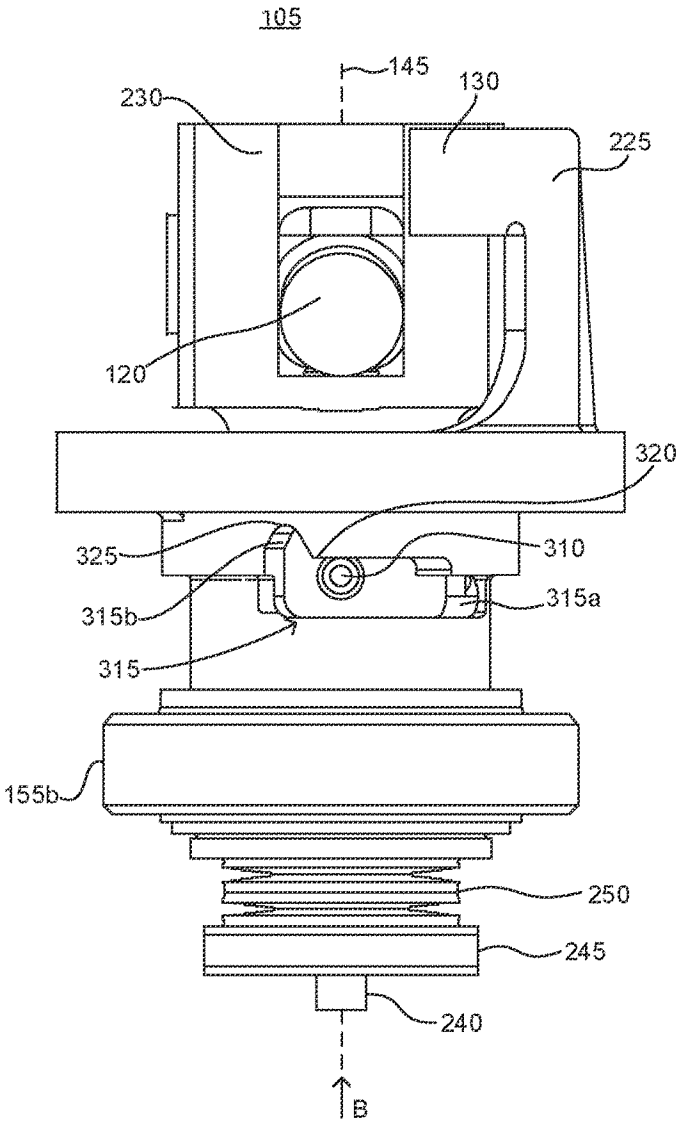
FIG. 3B shows the deployment and actuation device of FIG. 3A as viewed from direction A, with the output gear of the deployment and actuation device rotated 30 degrees clockwise about the longitudinal axis of the device when viewed from direction B.
Figure 3A:
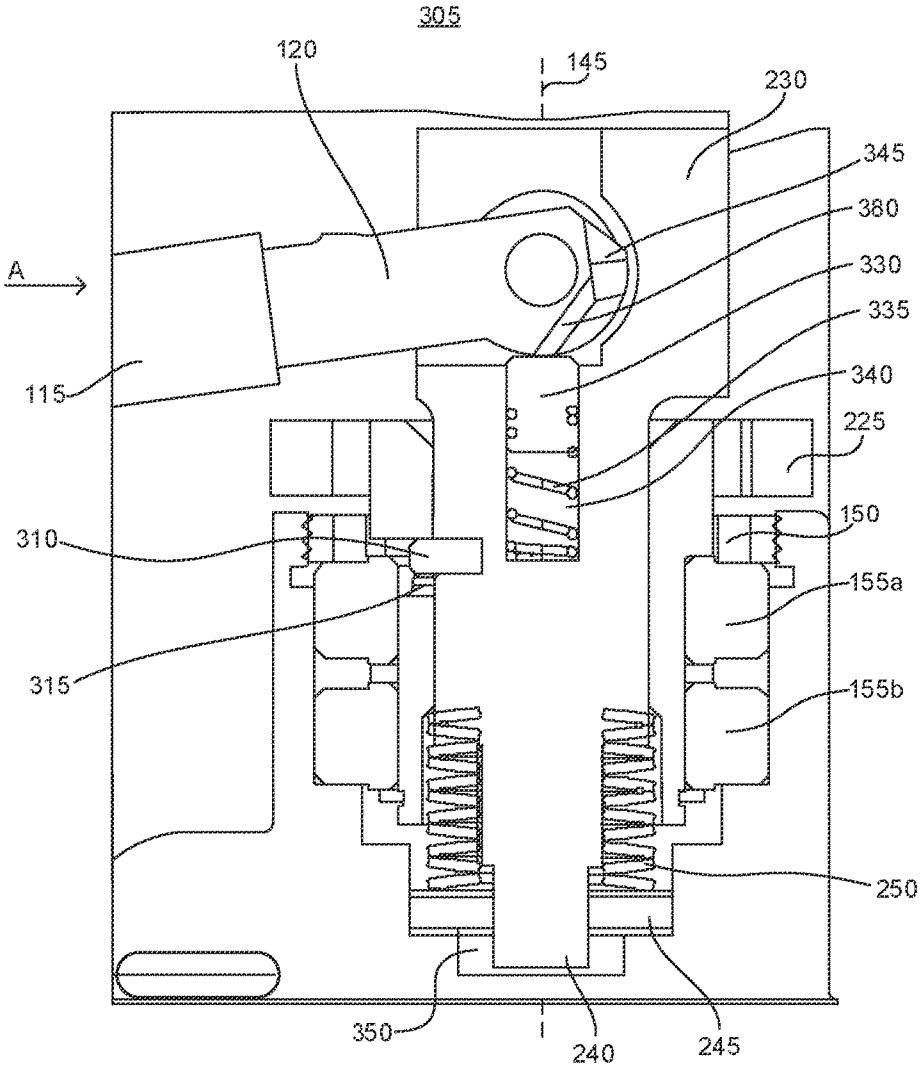
FIG. 3A shows a device portion of the FIG. 1 cross-section with an output gear of the deployment and actuation device rotated 30 degrees clockwise about a longitudinal axis of the device when viewed from direction B.

Turning now to FIGS. 3A and 3B, FIG. 3A shows a device portion 305 of the FIG. 1 cross-section with the output gear 225 of the deployment and actuation device 105 rotated 30 degrees clockwise about the longitudinal axis 145 of the device 105 when viewed from direction B; and FIG. 3B shows the deployment and actuation 105 device of FIG. 3A as viewed from direction A, with the output gear 225 of the deployment and actuation device 105 rotated 30 degrees clockwise about the longitudinal axis of the device when viewed from direction B. As can be seen from FIGS. 3A and 3B, the actuation shaft 230 includes a pin 310 integral with, or attached to, the actuation shaft 230 and protruding through an opening 315 in the output gear 225. The opening 315 has a circumferentially extending portion 315*a* extending circumferentially about the longitudinal axis 145 and a longitudinally extending portion 315*b* extending along the longitudinal axis 145. The output gear 225 is operable to rotate about the longitudinal axis 145 independent of the actuation shaft 230 when the pin 310 is in the circumferentially extending portion 315*a* of the opening 315, and the output gear 225 and actuation shaft 230 are operable to rotate together about the longitudinal axis 145 when the pin 310 is in the longitudinally extending portion 315*b* of the opening 315.

In the depiction of FIGS. 3A and 3B, the restraint portion 130 no longer bears on the control surface shaft 120 but the control surface 115 is not yet deployed. Such depiction is provided for illustrative purposes, although it is noted that as a practical matter the control surface 115 will deploy as soon as the restraint portion 130 clears the control surface shaft 120. In any event, when the output gear 225 is in the position shown in FIGS. 3A and 3B, the pin 310 is urged against a bearing surface 320 of the circumferentially extending portion 315*a* of the opening 315. That is, the pin 310 is urged against a bearing surface 320 of the circumferentially extending portion 315*a* of the opening 315 when the deployment and actuation device 105 is not in a driving position, the driving position being a position in which the pin 310 is urged against a bearing surface 325 of the longitudinally extending portion 315*b* of the opening 315. The force urging the pin 310 against the bearing surface 320, or the bearing surface 325, results from the compression of spring 250 between the actuation shaft 230 and the thrust bearing 245.

As can be further seen from FIGS. 3A and 3B, the deployment and actuation device 105 may include a plunger 330 and a plunger spring 335 accommodated in a plunger space 340 within the actuation shaft 230. The plunger 330 slidably bears on the control surface shaft 120 and mates with a control surface shaft recess 345 of the control surface shaft 120 when the control surface 115 is in the deployed position. Nevertheless, it is noted that the plunger 330, the plunger spring 335, and the plunger space 340 are optional elements. A deployment and actuation device according to the present technology may be provided without such elements, in which case the control surface shaft recess 345 is also an optional element.

In addition, it is noted that in FIGS. 3A and 3B, when the deployment and actuation device 105 is not in a driving position, the anti-rotation tab 240 is within anti-rotation tab recess 350 of the body 127.

Figure 4B:
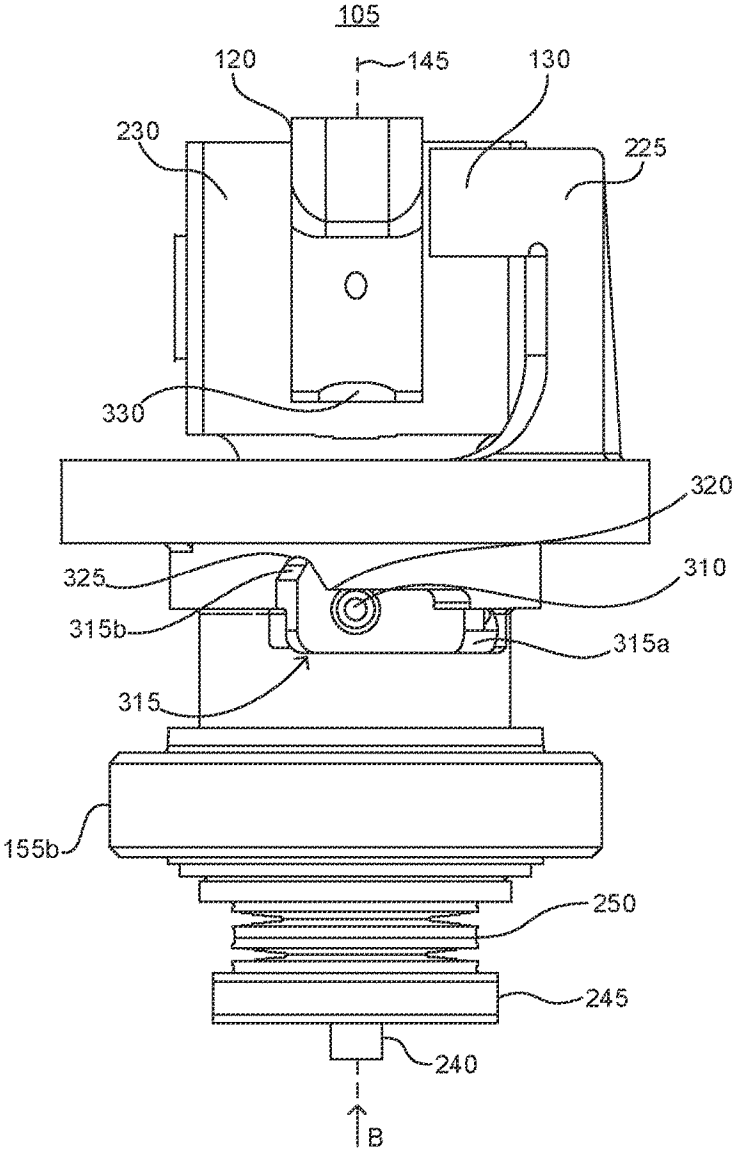
FIG. 4B shows the deployment and actuation device of FIG. 4A as viewed from direction A, with the output gear of the deployment and actuation device rotated 30 degrees clockwise about the longitudinal axis of the device when viewed from direction B, and with the control surface shaft locked in the deployed position.
Figure 4A:
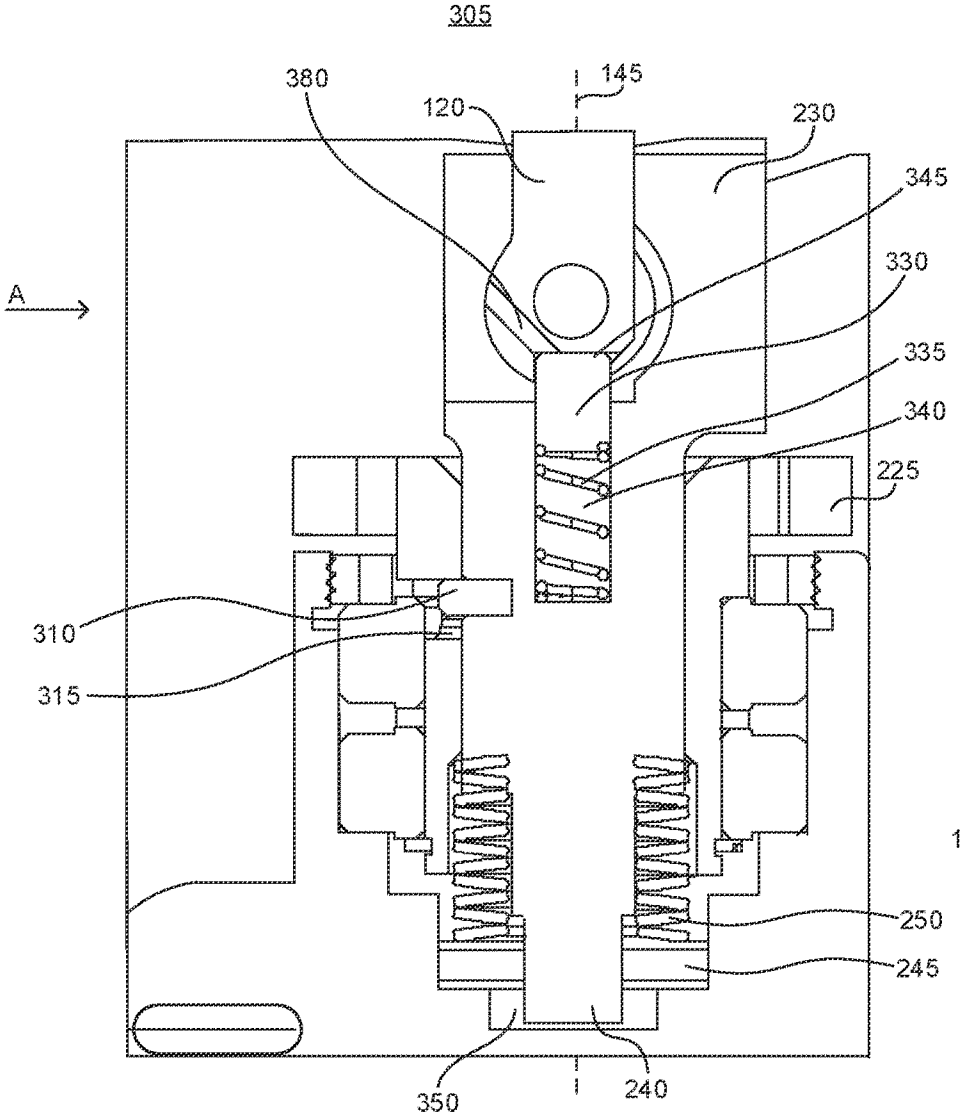
FIG. 4A shows the device portion of the FIG. 1 cross-section with the output gear of the deployment and actuation device rotated 30 degrees clockwise about the longitudinal axis of the device when viewed from direction B, and with a control surface shaft locked in a deployed position.

Referring now to FIGS. 4A and 4B, FIG. 4A shows the device portion 305 of the FIG. 1 cross-section with the output gear 225 of the deployment and actuation device 105 rotated 30 degrees clockwise about the longitudinal axis 145 of the device 105 when viewed from direction B, and with the control surface shaft 120 locked in a deployed position; and FIG. 4B shows the deployment and actuation device 105 of FIG. 4A as viewed from direction A, with the output gear 225 of the deployment and actuation device 105 rotated 30 degrees clockwise about the longitudinal axis 145 of the device 105 when viewed from direction B, and with the control surface shaft 120 locked in the deployed position. As can be seen from FIGS. 4A and 4B, when the control surface shaft 120 reaches the deployed position the control surface shaft recess 345 of the control surface shaft 120 is positioned to receive plunger 330, which is moved into the recess 345 by the force of the plunger spring 335. In this manner, the control surface shaft 120 and, in turn, the control surface 115 are secured in the deployed position.

As can be further seen from FIGS. 4A and 4B, the deployment and actuation device 105 is not in the driving position. That is, in the FIGS. 4A and 4B state, the output gear 225 has not rotated far enough to allow the pin 310 to move into the longitudinally extending portion 315*b* of opening 315, even though the output gear 225 has rotated far enough to free the control surface shaft 120 from being restrained by the restraint portion 130. Accordingly, the pin 310 remains in the circumferentially extending portion 315*a* of opening 315, bearing against the bearing surface 320, and thereby preventing the actuation tab 240 from leaving recess 350. Thus, in FIGS. 4A and 4B the deployment and actuation device 105 is in a deployed position but not in a driving position. The position depicted in FIGS. 4A and 4B may be maintained, if desired, by holding the output gear 225 at the depicted rotation. In such arrangement, the actuation tab 240 remains in recess 350, keeping the control surface 120 at mechanical null, with no actuation force or motor load being applied, prior to transitioning to the driving position.

Figure 5B:
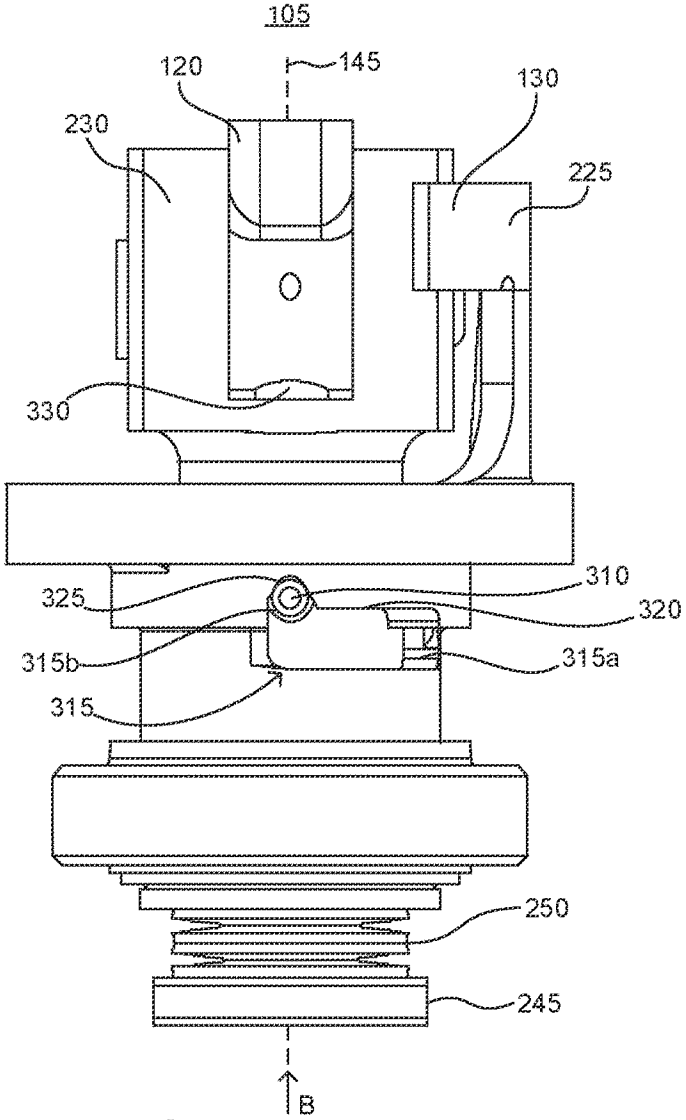
FIG. 5B shows the deployment and actuation device of FIG. 5A as viewed from direction A, with the output gear of the deployment and actuation device rotated 50 degrees clockwise about the longitudinal axis of the device when viewed from direction B, with the control surface shaft locked in the deployed position, and with the actuation shaft of the device translated in direction B.
Figure 5A:
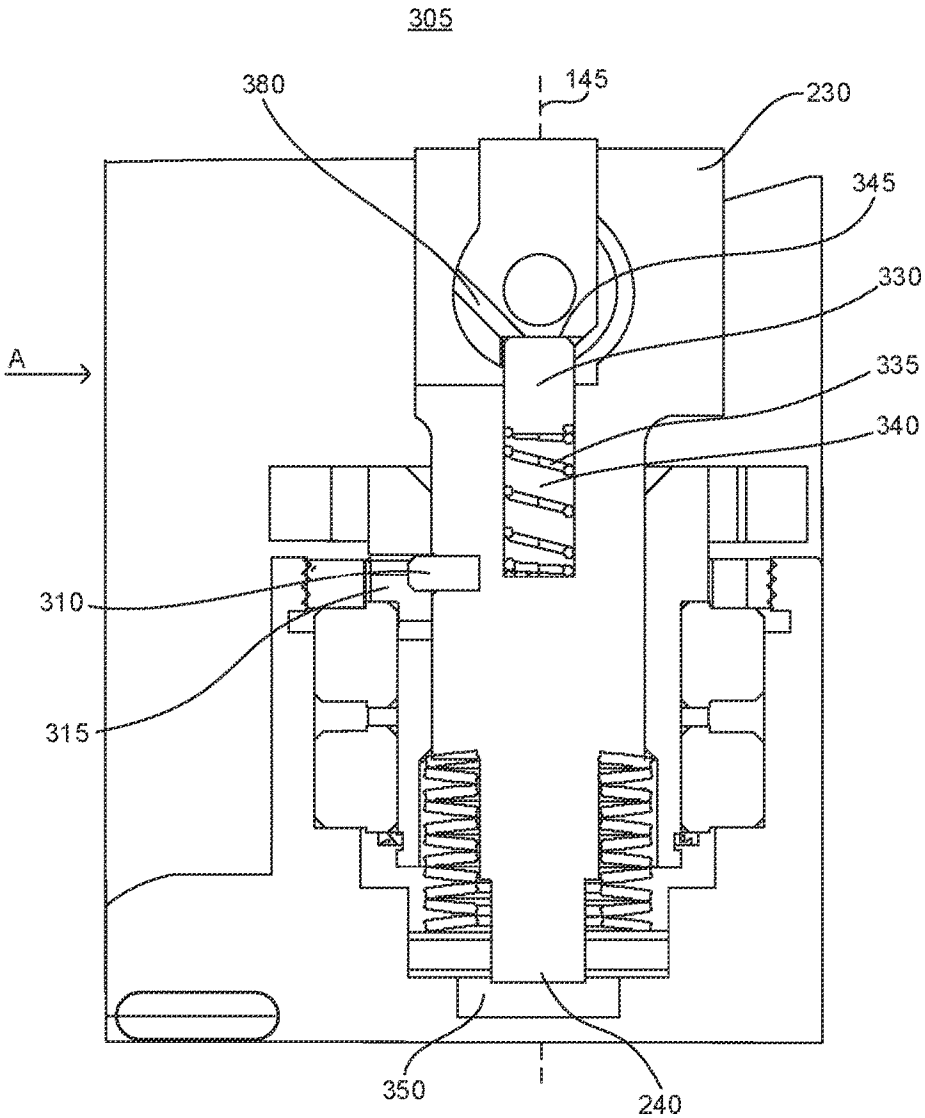
FIG. 5A shows the device portion of the FIG. 1 cross-section with the output gear of the deployment and actuation device rotated 50 degrees clockwise about the longitudinal axis of the device when viewed from direction B, with the control surface shaft locked in the deployed position, and with an actuation shaft of the device translated in direction B.

FIGS. 5A and 5B show the deployment and actuation device 105 in the driving position. More specifically, FIG. 5A shows the device portion 305 of the FIG. 1 cross-section with the output gear 225 of the deployment and actuation device 105 rotated 50 degrees clockwise about the longitudinal axis 145 of the device 105 when viewed from direction B, with the control surface shaft 120 locked in the deployed position, and with the actuation shaft 230 of the device 105 translated in direction B; and FIG. 5B shows the deployment and actuation device of 105 of FIG. 5A as viewed from direction A, with the output gear 225 of the deployment and actuation device 105 rotated 50 degrees clockwise about the longitudinal axis 145 of the device 105 when viewed from direction B, with the control surface shaft 120 locked in the deployed position, and with the actuation shaft 230 of the device 105 translated in direction B. As can be seen from FIGS. 5A and 5B, when the output gear 225 is rotated to the 50 degree position, the pin 310 is free to move into the longitudinally extending portion 315*b* of opening 315, and does so in response to the force of compressed spring 250, settling against bearing surface 325. At the same time, the anti-rotation tab 240 moves free of recess 350. As such, with the pin 310 coupling the output gear 225 and the actuation shaft 230 for co-rotation, the actuation shaft 230 being free to rotate, and the control surface shaft 120 locked in the deployed position, the deployment and actuation device 105 is in the driving position. In the driving position, rotation of output gear 225 causes rotation of the actuation shaft 230 to thereby move the control surface 115 via the control surface shaft 120.

It should be noted from FIGS. 3B, 4B, and 5B that the bearing surface 325 of longitudinally extending portion 315*b* of opening 315 is generally V-shaped. The V-shape assures that when pin 310 is urged into the longitudinally extending portion 315*b*, and against the bearing surface 325, by spring 250, the pin 310 is secured in the longitudinally extending portion 315*b* in a manner that does not allow the pin 310 to shift in a circumferential direction. Thereby, preventing backlash, or the unintended circumferential movement of pin 310 and resultant unintentional rotation of actuation shaft 230 when the deployment and actuation device 105 is in the driving position. To illustrate by contrast, a U-shaped bearing surface 325 would necessitate a circumferential clearance between the bearing surface 325 and the pin 310 to allow for positioning of the pin 310 against the bearing surface 325, and such clearance would allow for unintentional circumferential movement of pin 310 within the longitudinally extending portion 315*b*. Accordingly, embodiments of the presently disclosed technology include embodiments having a V-shaped bearing surface such as bearing surface 325.

It should be further noted that while the configurations presented in FIGS. 3A-5B have a single pin, pin 310, and a single opening, opening 315, the present technology includes embodiments that have more than one pin. For instance, the actuation shaft 230 may include two or more pins integral with, or attached to, the actuation shaft 230 and protruding through respective openings in the output gear 225.

Still further, it should be noted that the 30 degree rotation shown in FIGS. 3A-4B and the 50 degree rotation shown in FIGS. 5A and 5B are merely illustrative. That is, the control shaft 120 may be freed from restraint by the restraint portion 130 upon the output gear 225 rotating more or less than 30 degrees; and the pin 310 may be free to move into the longitudinally extending portion 315*b* of opening 315 upon the output gear 225 rotating more or less than 50 degrees. For example, the control shaft 120 may be freed from restraint by the restraint portion 130 upon the output gear 225 rotating 20 degrees, and the pin 310 may be free to move into the longitudinally extending portion 315*b* of opening 315 upon the output gear 225 rotating 45 degrees. In another example, the angle of rotation of the output gear 225 at which the control shaft 120 is freed from restraint by the restraint portion 130, and the angle of rotation of the output gear 225 at which the pin 310 is free to move into the longitudinally extending portion 315*b* of opening 315, may be the same angle. A mechanism for rotating the output gear 225 is shown in FIG. 6.

Figure 6:
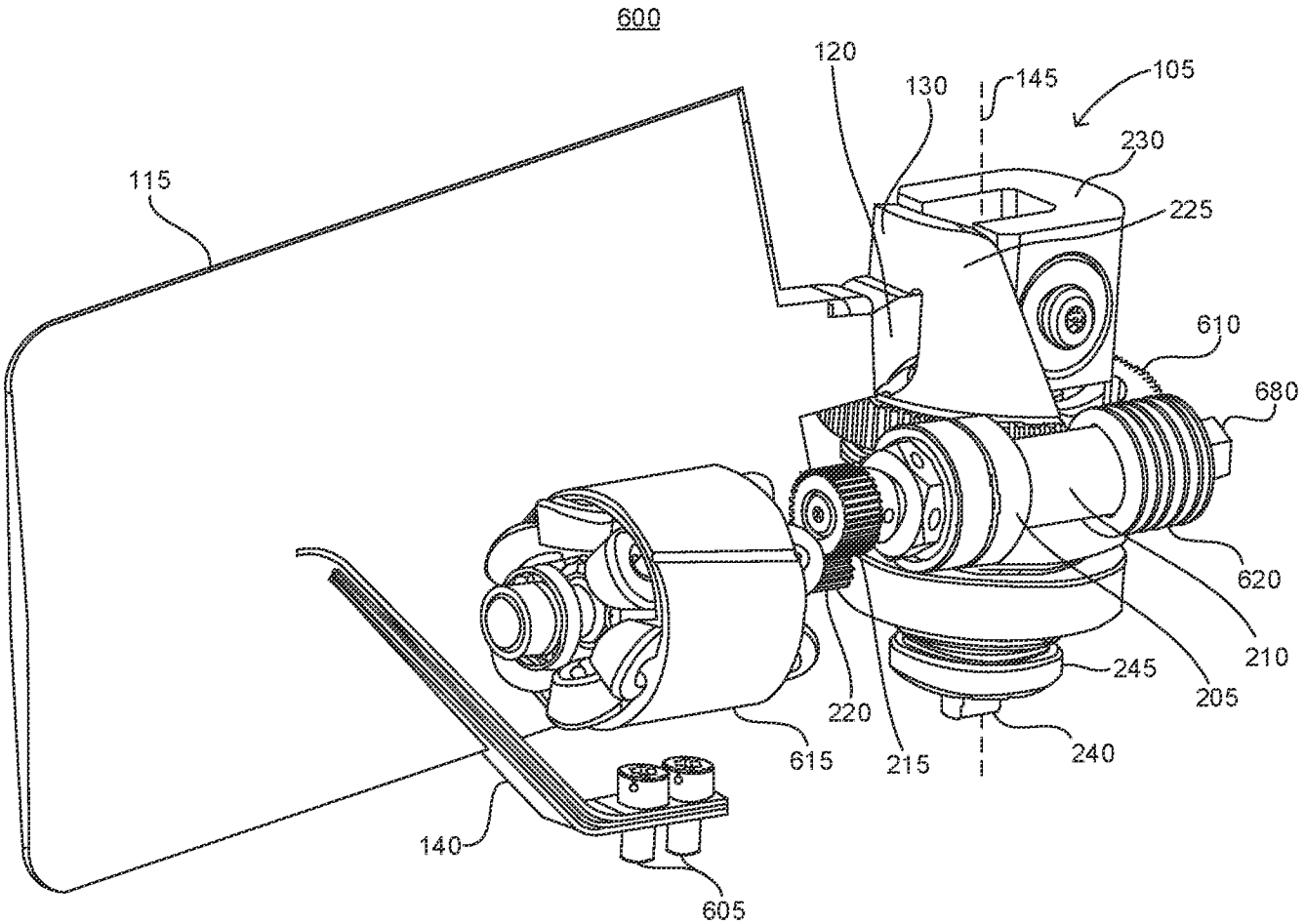
FIG. 6 is an isometric view of a control surface system in accordance with the presently disclosed technology.
Figure 7:
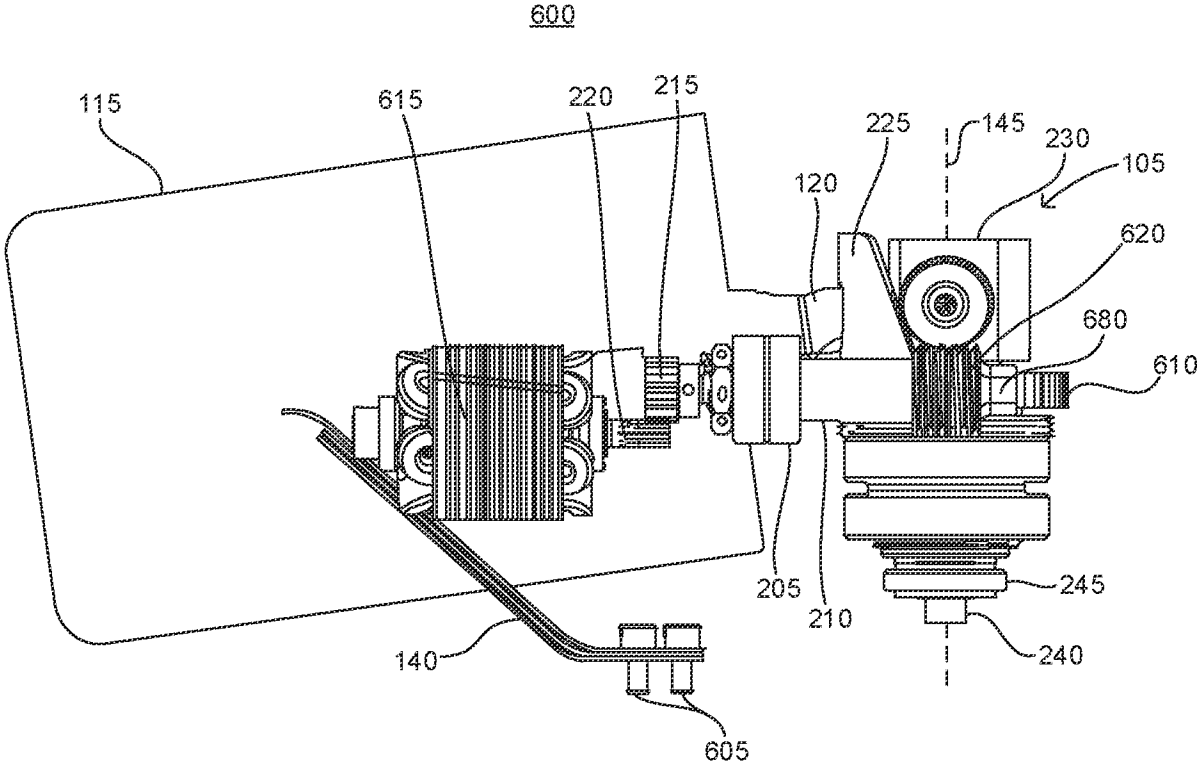
FIG. 7 is a profile view of the control surface system of FIG. 6.

FIG. 6 is an isometric view of a control surface system 600 in accordance with an embodiment of the presently disclosed technology. FIG. 7 is a profile view of the control surface system 600 FIG. 6. In FIGS. 6 and 7, the body surface 125 and body 127 are not shown. As can be seen from FIGS. 6 and 7, the control surface system 600 includes the control surface 115, the control surface shaft 120, the deployment spring 140, and the deployment and actuation device 105. The deployment spring 140 is shown in an uncompressed state for clarity of presentation. The deployment spring 140 may be secured to the body 127 by two bolts 605.

As can be further seen from FIGS. 6 and 7, the deployment and actuation device 105 may include teeth 610 on part of an outer surface of the output gear 225. The teeth 610 are provided for engaging a driving mechanism operable to drive the output gear 225. In the configuration of FIGS. 6 and 7, the driving mechanism takes the form of an electric motor 615 coupled to a drive gear 620 (e.g., a worm gear). The motor 615 may be coupled to the drive gear 620, for example, by the spur gear 220, the driveshaft gear 215, and the driveshaft 210. In operation, the teeth 610 engage the drive gear 620 so that the drive gear 620 can rotate the output gear 225 about the longitudinal axis 145. The drive gear 620 may rotate the output gear 225 independent of the actuation shaft 230 when the pin 310 is in the circumferentially extending portion 315*a* of the opening 315, and may rotate the output gear 225 and actuation shaft 230 together about the longitudinal axis 145 when the pin 310 is in the longitudinally extending portion 310*b* of the opening 315. By using a single motor to implement both deployment and actuation of a control surface, the presently disclosed technology offers advantages over systems that require both a deployment motor and an actuation motor; namely, reduced complexity, reduced part count, reduced cost, and reduced packaging requirements.

It should be noted that the drive mechanism depicted in FIGS. 6 and 7 allows for positive retention of the control surface 115. More particularly, since (i) the position of the control surface 115 is determined by the rotation position of the output gear 225, (ii) the rotation position of the output gear 225 is controlled via the coupling of the drive gear 620 to teeth 610, and (iii) the drive gear 620 is a worm gear in FIGS. 6 and 7, the position of the control surface 115 cannot change without the drive gear 620 being rotated via driveshaft 210-provided there is an adequate gear ratio between the drive gear 620 and teeth 610. That is, the drive gear 620 may not be backdrivable. Thus, the arrangement of the drive gear 620 and teeth 610 may maintain the control surface 115 at mechanical null with little or no assistance from motor 615, and may do so in each of the stowed position, the deployment position, and the drive position.

In any case, the driving mechanism of FIGS. 6 and 7 is merely illustrative. Upon review of this disclosure, one skilled in the art will readily appreciate the wide range of alternative driving mechanisms that may be employed with the presently disclosed technology.

Additionally, it should be noted that control surface systems of the presently disclosed technology may be resettable. For instance, the control surface system 600 may be reset during a testing and development phase. The ability to reset the system 600 is highly advantageous as a resettable system reduces the burdens associated with testing the system, e.g., in a laboratory, with attendant reductions in time and cost of system development. To provide for the resetting of system 600, a reset access 380 is included in control shaft 120 (see e.g., FIGS. 3A-5A), and a manual interface portion 680 is included on driveshaft 210 (see FIGS. 6 and 7). To reset the system 600 from the driving position to the stowed position, one inserts a suitably sized rod or pin into reset access 380 to depress the plunger spring 335 and force the plunger 330 out of the control surface shaft recess 345 (see e.g., FIG. 5A), thereby allowing the control shaft 120 to rotate in a generally outboard-to-inboard direction and from the deployed position to the stowed position. Also, the actuation shaft 230 is moved from its generally outboard position to its stowed position by applying manual force to overcome the outboard directed force of spring 250. Once the control shaft 120 and actuation shaft 230 have been moved into their stowed positions, the manual interface portion 680 (see e.g., FIG. 6) is turned to rotate drive gear 620 and, in turn, rotate output gear 225 until the restraint portion 130 is positioned to retain the control shaft 120 in the stowed position and the pin is positioned in the circumferentially extending portion 315*a*. Thereby, completing the reset. In some embodiments, the manual interface portion 680 may be hexagonally shaped and may be turned through use of a socket wrench.

Embodiments of the present technology include, but are not restricted to, the following.

(1) A device for deployment and actuation of a control surface for a maneuverable object, including an actuation shaft configured for pivotal mounting to a control surface shaft, arranged for rotation about a longitudinal axis of the device, and operable to move the control surface shaft when rotated about the longitudinal axis; an output gear arranged concentric with the actuation shaft, arranged for rotation about the longitudinal axis, and configured to unlock the control surface from a stowed position when rotated about the longitudinal axis; and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

(2) The device according to (1), further including an anti-rotation tab integral with the actuation shaft or attached to the actuation shaft, the anti-rotation tab maintaining the control surface at mechanical null when the pin is in the circumferentially extending portion of the opening.

(3) The device according to (1), further including a spring compressed against the actuation shaft such that the pin is urged against a bearing surface of the circumferentially extending portion of the opening when the deployment and actuation device is not in a driving position and is urged against a bearing surface of the longitudinally extending portion of the opening when the control surface is in the driving position.

(4) The device according to (3), wherein the bearing surface of the longitudinally extending portion of the opening is generally V-shaped.

(5) The device according to (3), further including a thrust bearing arranged around the anti-rotation tab to allow for movement of the anti-rotation tab, and wherein the spring has a first end bearing against the thrust bearing and a second end bearing against the actuation shaft.

(6) The device according to (1), further including a plunger and a plunger spring accommodated in a plunger space within the actuation shaft, the plunger and the plunger spring being operable to lock the control surface in a deployed position by the plunger spring urging the plunger into a control surface shaft recess in the control surface shaft when the control surface is in the deployed position.

(7) The device according to (1), wherein the output gear includes teeth on an outer surface of the output gear, the teeth being operable to engage a drive gear such that the drive gear can rotate the output gear about the longitudinal axis independent of the actuation shaft when the pin is in the circumferentially extending portion of the opening, and can rotate the output gear and actuation shaft together about the longitudinal axis when the pin is in the longitudinally extending portion of the opening.

(8) The device according to (7), wherein the drive gear is a worm gear.

(9) The device according to (7), further including a motor coupled to the drive gear and operable to rotate the drive gear.

(10) The device according to (9), wherein the motor is coupled to the drive gear by a spur gear, a driveshaft gear, and a driveshaft.

(11) The device according to (1), further including a spanner nut and one or more roller bearings for securing the device within the maneuverable object.

(12) The device according to (1), further including one or more deployment springs, the one or more deployment springs being mounted to the maneuverable object and compressed against the control surface when the control surface is in the stowed position.

(13) The device according to (1), further including the control surface shaft.

(14) The device according to (13), wherein the control surface shaft includes a reset access.

(15) A control surface system for a maneuverable object, including a control surface; a control surface shaft integral with, or attached to, the control surface; and a device for deployment and actuation of the control surface, the device having an actuation shaft configured for pivotal mounting to the control surface shaft, arranged for rotation about a longitudinal axis of the device, and operable to move the control surface shaft when rotated about the longitudinal axis, an output gear arranged concentric with the actuation shaft, arranged for rotation about the longitudinal axis, and configured to unlock the control surface from a stowed position when rotated about the longitudinal axis, and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

(16) The system according to (15), further including one or more deployment springs, the one or more deployment springs being mounted to the maneuverable object and compressed against the control surface when the control surface is in the stowed position.

(17) The system to according to (15), wherein the control surface is stored sub-flush to the body of the maneuverable object.

(18) The system according to (15), wherein the control surface shaft includes a reset access.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description should be taken by way of illustration rather than by way of limitation of the subject matter defined by the claims.

The invention claimed is:

1. A device for deployment and actuation of a control surface for a maneuverable object, comprising:

an actuation shaft configured for pivotal mounting to a control surface shaft, arranged for rotation about a longitudinal axis of the device, and operable to move the control surface shaft when rotated about the longitudinal axis;

an output gear arranged concentric with the actuation shaft, arranged for rotation about the longitudinal axis, and configured to unlock the control surface from a stowed position when rotated about the longitudinal axis; and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

2. The device according to claim 1, further comprising an anti-rotation tab integral with the actuation shaft or attached to the actuation shaft, the anti-rotation tab maintaining the control surface at mechanical null when the pin is in the circumferentially extending portion of the opening.

3. The device according to claim 1, further comprising a spring compressed against the actuation shaft such that the pin is urged against a bearing surface of the circumferentially extending portion of the opening when the deployment and actuation device is not in a driving position and is urged against a bearing surface of the longitudinally extending portion of the opening when the control surface is in the driving position.

4. The device according to claim 3, wherein the bearing surface of the longitudinally extending portion of the opening is generally V-shaped.

5. The device according to claim 3, further comprising a thrust bearing arranged around the anti-rotation tab to allow for movement of the anti-rotation tab, and wherein the spring has a first end bearing against the thrust bearing and a second end bearing against the actuation shaft.

6. The device according to claim 1, further comprising a plunger and a plunger spring accommodated in a plunger space within the actuation shaft, the plunger and the plunger spring being operable to lock the control surface in a deployed position by the plunger spring urging the plunger into a control surface shaft recess in the control surface shaft when the control surface is in the deployed position.

7. The device according to claim 1, wherein the output gear includes teeth on an outer surface of the output gear, the teeth being operable to engage a drive gear such that the drive gear can rotate the output gear about the longitudinal axis independent of the actuation shaft when the pin is in the circumferentially extending portion of the opening, and can rotate the output gear and actuation shaft together about the longitudinal axis when the pin is in the longitudinally extending portion of the opening.

8. The device according to claim 7, wherein the drive gear is a worm gear.

9. The device according to claim 7, further comprising a motor coupled to the drive gear and operable to rotate the drive gear.

10. The device according to claim 9, wherein the motor is coupled to the drive gear by a spur gear, a driveshaft gear, and a driveshaft.

11. The device according to claim 1, further comprising a spanner nut and one or more roller bearings for securing the device within the maneuverable object.

12. The device according to claim 1, further comprising one or more deployment springs, the one or more deployment springs being mounted to the maneuverable object and compressed against the control surface when the control surface is in the stowed position.

13. The device according to claim 1, further comprising the control surface shaft.

14. The device according to claim 13, wherein the control surface shaft comprises a reset access.

15. A control surface system for a maneuverable object, comprising:

a control surface;

a control surface shaft integral with, or attached to, the control surface; and a device for deployment and actuation of the control surface, the device comprising an actuation shaft configured for pivotal mounting to the control surface shaft, arranged for rotation about a longitudinal axis of the device, and operable to move the control surface shaft when rotated about the longitudinal axis, an output gear arranged concentric with the actuation shaft, arranged for rotation about the longitudinal axis, and configured to unlock the control surface from a stowed position when rotated about the longitudinal axis, and a pin integral with, or attached to, the actuation shaft and protruding through an opening in the output gear, the opening having a circumferentially extending portion extending circumferentially about the longitudinal axis and a longitudinally extending portion extending along the longitudinal axis, wherein the output gear is operable to rotate about the longitudinal axis independent of the actuation shaft when the pin is in the circumferentially extending portion of the opening, and the output gear and actuation shaft are operable to rotate together about the longitudinal axis when the pin is in the longitudinally extending portion of the opening.

16. The system according to claim 15, further comprising one or more deployment springs, the one or more deployment springs being mounted to the maneuverable object and compressed against the control surface when the control surface is in the stowed position.

17. The system according to claim 15, wherein the control surface is stored sub-flush to the body surface of the maneuverable object.

18. The system according to claim 15, wherein the control surface shaft comprises a reset access.

* * * * *